US008848926B2

(12) United States Patent
Seo et al.

(10) Patent No.: US 8,848,926 B2
(45) Date of Patent: Sep. 30, 2014

(54) APPARATUS AND METHOD FOR RESTORING MULTI-CHANNEL AUDIO SIGNAL USING HE-AAC DECODER AND MPEG SURROUND DECODER

(75) Inventors: Jeong-Il Seo, Daejeon (KR); Seung-Kwon Beack, Daejeon (KR); In-Seon Jang, Gyeonggi-do (KR); Dae-Young Jang, Daejon (KR); Jin-Woo Hong, Daejon (KR); Jin-Woong Kim, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 0 days.

(21) Appl. No.: 13/449,883

(22) Filed: Apr. 18, 2012

(65) Prior Publication Data

US 2012/0201388 A1 Aug. 9, 2012

Related U.S. Application Data

(62) Division of application No. 12/307,289, filed as application No. PCT/KR2007/003247 on Jul. 4, 2007, now Pat. No. 8,611,547.

(30) Foreign Application Priority Data

Jul. 4, 2006 (KR) ..... 10-2006-0062609
Jul. 13, 2006 (KR) ..... 10-2006-0065948

(51) Int. Cl.

| | |
|---|---|
| ***H04R 5/00*** | (2006.01) |
| ***G10L 19/008*** | (2013.01) |
| ***G10L 19/02*** | (2013.01) |
| *G10L 19/18* | (2013.01) |

(52) U.S. Cl.

CPC ..... *G10L 19/008* (2013.01); *G10L 19/18* (2013.01); *G10L 19/02* (2013.01)
USPC ..... 381/22; 700/94

(58) Field of Classification Search

CPC ..... H04S 3/02; H04S 5/005; G10L 19/008
USPC ..... 381/1, 17–23, 119, 63; 700/94; 704/500, 203, 501, 503
See application file for complete search history.

(56) References Cited

U.S. PATENT DOCUMENTS 5,568,142 A 10/1996 Velazquez et al.
6,236,432 B1 * 5/2001 Lee ..... 375/240.26

(Continued)

FOREIGN PATENT DOCUMENTS

CN 1202782 A 12/1998
CN 1472957 A 2/2004

(Continued)

OTHER PUBLICATIONS

Martin Wolters, et al; "A closer look into MPEG-4 Efficiency AAC", In: Proc. 115$^{th}$ AES Convention, Oct. 10, 2003, New York, NY, USA, pp. 1-16.

(Continued)

*Primary Examiner* — Lao Lun-See
(74) *Attorney, Agent, or Firm* — Ladas & Parry LLP

(57) ABSTRACT

Provided is a method for controlling synchronizing downmix signals and MPEG surround side information signals by controlling a delay according to the kind of downmix audio signals in an MPEG surround decoder. When multi-channel audio signals are restored using an HE-AAC decoder and a low-power MPEG surround decoder and complex QMF signals outputted from the HE-AAC decoder are used as downmix signals, a delay unit compensates for a delay caused in a real-to-complex converter. Anther delay unit delays spatial parameters to compensate for a delay caused in QMF and Nyquist banks when time-domain downmix signals are used. Also, when multi-channel audio signals are restored using an HE-AAC decoder and a high-quality MPEG surround decoder and complex QMF signals outputted from the HE-AAC decoder are used as downmix signals, a delay unit compensates for a delay caused in a real-to-complex converter.

7 Claims, 4 Drawing Sheets

(56) References Cited

U.S. PATENT DOCUMENTS

| | | | | |
|---|---|---|---|---|
| 2004/0091245 | A1 | 5/2004 | Yamasaki et al. | |
| 2007/0100612 | A1* | 5/2007 | Ekstrand et al. | 704/220 |
| 2008/0205671 | A1* | 8/2008 | Oh et al. | 381/119 |
| 2010/0329467 | A1* | 12/2010 | Pang et al. | 381/22 |

FOREIGN PATENT DOCUMENTS

| | | | |
|---|---|---|---|
| EP | 0 287 741 | A1 | 10/1988 |
| EP | 1 484 747 | A1 | 12/2004 |
| JP | 63-273898 | A | 11/1988 |
| JP | 10-507891 | A | 7/1998 |
| JP | 2005-101370 | A | 4/2005 |
| JP | 1020060122693 | A | 11/2006 |
| JP | 2009-512899 | A | 3/2009 |
| KR | 1020050073915 | A | 7/2005 |
| KR | 1020070037983 | A | 4/2007 |
| KR | 1020070037984 | A1 | 4/2007 |
| WO | 2007/049861 | A1 | 5/2007 |

OTHER PUBLICATIONS

J. Herre, et al; "The Reference Model Architecture for Mpeg Spatial Audio Coding", In; Proc. 118$^{th}$ AES Convention, May 28-31, 2005, Barcelona, Spain, pp. 1-13.

Heiko Purnhagen; "Low Complexity Parametric Stereo Coding in MPEG-4", Proc. of the 7$^{th}$ Int. Conference on Digital Audio Effects (DAFx'04), Naples, Italy, Oct. 5, 2004, pp. 163-168.

David Dorran, et al; "Multi-Channel Audio Time-Scale Modification", Audio Engineering Society Convention Paper Presented at the 119$^{th}$ Convention Oct. 7-10, 2005, New York, New York, USA; pp. 1-7.

International Search Report: mailed Oct. 10, 2007, PCT/KR2007/003247.

J. Breebaart, et al; "MPEG Spatial Audio Coding / MPEG Surround: Overview and Current Status", Audio Engineering Society Convention Paper Presented at the 119$^{th}$ Convention, Oct. 7-10, 2005, New York, New York, USA, 17 pages.

International Orgainization for Standardization; "International Standard ISO/IEC 23003-1 Information technology—MPEG audio technologies Part 1: MPEG Surround", First Edition Feb. 15, 2007, 288 pages.

* cited by examiner

APPARATUS AND METHOD FOR RESTORING MULTI-CHANNEL AUDIO SIGNAL USING HE-AAC DECODER AND MPEG SURROUND DECODER

TECHNICAL FIELD

The present invention relates to an apparatus and method for synchronizing downmix signals with Moving Picture Experts Group (MPEG) surround side information signals at an MPEG surround decoder by accounting for delay according to the kind of a downmix audio signal. Particularly, the present invention relates to an apparatus and method for maintaining the synchronization of multi-channel audio signals outputted from an MPEG surround decoder by accounting for different delays between downmix signals of the time domain and downmix signals of the Quadrature Mirror Filter (QMF) domain signals, when the MPEG surround decoder is linked with the HE-AAC decoder.

BACKGROUND ART

Moving Picture Experts Group (MPEG) surround technology compresses multi-channel audio signals into downmix signals and side information. The MPEG surround technology can implement a decoder for the downmix signals and the side information bitstream transmitted from an encoder in either high-quality mode or low-power mode. A high-quality MPEG surround decoder provides high audio quality by using a residual signal and a temporal processing (TP) tool, but it requires a high degree of complexity. On the contrary, a low-power MPEG surround decoder reduces the complexity in such a method as changing computation of a Quadrature Mirror Filter (QMF) into a real number computation. Although the audio quality is somewhat degraded, the low-power MPEG surround decoder is appropriate for terminals consuming low power such as mobile phones.

An MPEG surround decoder restores downmix signals compressed with a general mono/stereo audio encoder, e.g., an Advanced Audio Coded (AAC) encoder or a High-Efficiency Advanced Audio Coding (HE-AAC) encoder, into multi-channel audio signals by using side information bitstream. Since the side information bitstream used herein is provided for each frequency band, the downmix signals should be converted to frequency bands using a hybrid filter bank, which consists of a QMF bank and a Nyquist filter bank. This conversion causes a delay. When the downmix signals are acquired after QMF processing of the HE-AAC decoder, as in the MPEG surround decoder, signals of the QMF domain can be directly extracted and applied to the MPEG surround decoder to thereby prevent delay caused by filtering.

The high-quality MPEG surround decoder can use not only the downmix signals of the time domain but also the downmix signals of the QMF domain that are acquired from the HE-AAC decoding process, as shown in FIG. 1. When the downmix signals of the time domain are used, a delay corresponding to 704 samples occurs in the process of executing a QMF analysis filter bank 101 and a Nyquist analysis filter bank 102. Also, a delay corresponding to 0 sample occurs in a Nyquist synthesis filter bank 201 and a delay corresponding to 257 samples occurs in the QMF synthesis filter bank 202 in the synthesis process of multi-channel audio signals shown in FIG. 2. In total, a delay corresponding to 961 samples occurs. When downmix signals encoded with an HE-AAC encoder are used, signals of the QMF domain that can be acquired from the HE-AAC decoding process can be directly used because the QMF of the high-quality MPEG surround decoder and the QMF of the HE-AAC decoder are identical. Also, since look-ahead signals corresponding to 384 samples needed for Nyquist banks is already available in a Spectral Band Replication (SBR) tool of the HE-AAC decoder, there is an advantage that no delay occurs in the filtering process.

However, when the downmix signals encoded with the HE-AAC encoder are applied to the MPEG surround decoder in the time domain, spatial parameters extracted from MPEG surround side information signals are delayed by 961 samples, including the delay corresponding to 257 samples occurring in the QMF synthesis process of the HE-AAC decoder and the delay corresponding to 704 samples occurring in the QMF filtering and the Nyquist filtering processes of the high-quality MPEG surround decoder. Thus, the downmix signals are synchronized between the HE-AAC decoder and the high-quality MPEG surround decoder to thereby be restored to desired multi-channel signals.

References, "ISO/IEC JTC1/SC29/WG11 N8177, Study on Text of ISO/IEC FCD 23003-1, MPEG Surround", "Audio Engineering Society Convention Paper presented at the 115$^{th}$ Convention, Oct. 10 through 13, 2003, New York", and "Audio Engineering Society Convention Paper presented at the 119$^{th}$ Convention, Oct. 7 through 10, 2005, New York" are incorporated herein.

DISCLOSURE

Technical Problem

An embodiment of the present invention is directed to providing an apparatus and method for maintaining the synchronization of multi-channel audio signals outputted from an MPEG surround decoder by accounting for different delays between downmix signals of the time domain and downmix signals of the Quadrature Mirror Filter (QMF) domain signals, when the MPEG surround decoder is linked with the HE-AAC decoder.

Technical Solution

In accordance with an aspect of the present invention, there is provided an apparatus for restoring multi-channel audio signals by using a High-Efficiency Advanced Audio Coding (HE-AAC) decoder and a low-power Moving Picture Experts Group (MPEG) surround decoder, which includes: a real-to-complex converter for converting Quadrature Mirror Filter (QMF) signals of the real number domain, which are real QMF signals, outputted from the HE-AAC decoder into QMF signals of the complex number domain, which are complex QMF signals; and a delay unit for applying a delay caused in the real-to-complex converter to the complex QMF signals outputted from the HE-AAC decoder.

In accordance with another aspect of the present invention, there is provided an apparatus for restoring multi-channel audio signals by using an HE-AAC decoder and a low-power MPEG surround decoder, which includes: a delay unit for applying a delay caused in QMF bank and Nyquist filter bank to spatial parameters of time-domain downmix signals outputted from the HE-AAC decoder.

In accordance with another aspect of the present invention, there is provided an apparatus for restoring multi-channel audio signals by using a High-Efficiency Advanced Audio Coding (HE-AAC) decoder and a low-power Moving Picture Experts Group (MPEG) surround decoder, which includes: a real-to-complex converter for converting real QMF signals outputted from the HE-AAC decoder into complex QMF signals; a first delay unit for applying a delay caused in the real-to-complex converter to the complex QMF signals outputted from the HE-AAC decoder; and a second delay unit for applying a delay caused in the QMF bank and Nyquist filter bank to spatial parameters of time-domain downmix signals outputted from the HE-AAC decoder.

In accordance with another aspect of the present invention, there is provided an apparatus for restoring multi-channel audio signals by using an HE-AAC decoder and a high-quality MPEG surround decoder, which includes: a delay unit for applying a delay caused in a real-to-complex transformation process which is used in a low-power MPEG surround decoder to complex QMF signals outputted from the HE-AAC decoder.

In accordance with another aspect of the present invention, there is provided an MPEG surround decoder for restoring multi-channel audio signals based on downmix signals and side information bitstream that are inputted from an HE-AAC decoder, which includes: a real-to-complex converter for converting real QMF signals outputted from the HE-AAC decoder into complex QMF signals; and a first delay unit for applying a delay caused in the real-to-complex converter to the complex QMF signals outputted from the HE-AAC decoder.

In accordance with another aspect of the present invention, there is provided a method for restoring multi-channel audio signals based on downmix signals and side information bitstream that are inputted from an HE-AAC decoder, which includes the steps of: converting real QMF signals outputted from the HE-AAC decoder into complex QMF signals; and applying a delay caused in the real-to-complex transformation step to the complex QMF signals outputted from the real-to-complex transformation step.

Advantageous Effects

As described above, the technology of the present invention can restore desired multi-channel audio signals by sustaining synchronization between downmix signals and MPEG surround side information signals by adding a delay unit when the downmix signals outputted from the HE-AAC decoder are applied to the MPEG surround decoder in format of either signals of the real QMF domain or signals of the complex QMF domain.

BEST MODE FOR THE INVENTION

Embodiments of the invention will be described in detail with reference to the accompanying drawings.

Figure 1:
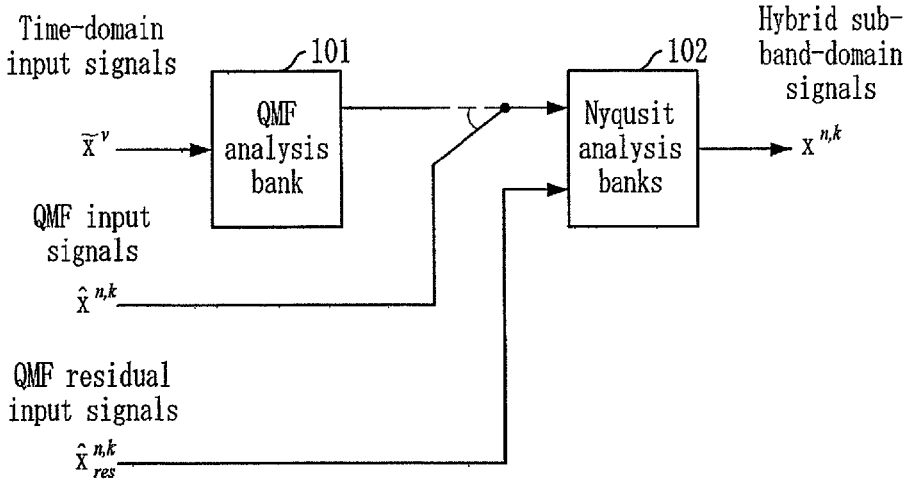
FIG. 1 is a block view showing a hybrid analysis filter bank of a high-quality Moving Picture Experts Group (MPEG) surround decoder.
Figure 2:
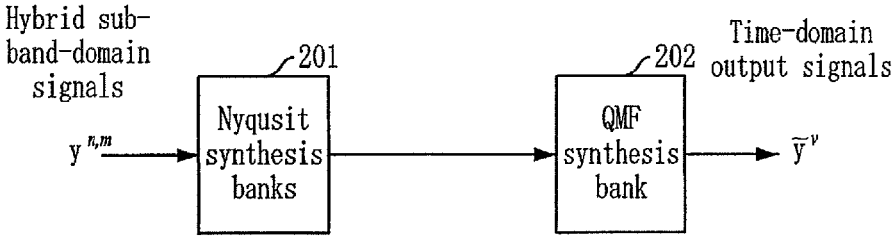
FIG. 2 is a block view showing a hybrid synthesis filter bank of the high-quality MPEG surround decoder.
Figure 3:
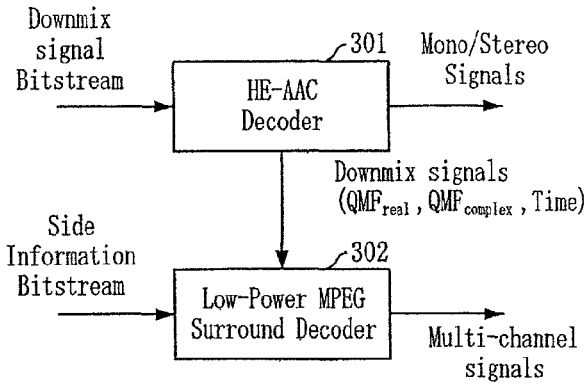
FIG. 3 illustrates a process for synthesizing multi-channel audio signals using an HE-AAC decoder and a low-power MPEG surround decoder.

First, FIG. 3 illustrates a process for synthesizing multi-channel audio signals using a HE-AAC decoder and a low-power MPEG surround decoder.

A HE-AAC decoder 301 receives downmix signal bitstream and outputs mono/stereo signals and downmix signals. The downmix signals outputted from the HE-AAC decoder 301 are inputted into a low-power MPEG surround decoder 302 along with side information bitstream, and the low-power MPEG surround decoder 302 restores and outputs multi-channel audio signals.

When the downmix signals are encoded in an HE-AAC encoder and side information is extracted from the multi-channel audio signals in an MPEG surround encoder, the downmix signals are decoded through the HE-AAC decoder 301, and the multi-channel audio signals are restored through the low-power MPEG surround decoder 302. Herein, the QMF coefficients of the downmix signals extracted from the HE-AAC decoder 301 are real numbers in case of a low-complexity HE-AAC decoder 301, or they are complex numbers in case of a general HE-AAC decoder. Also, downmix signals of the time domain may be extracted from the HE-AAC decoder 301 and used.

Figure 4:
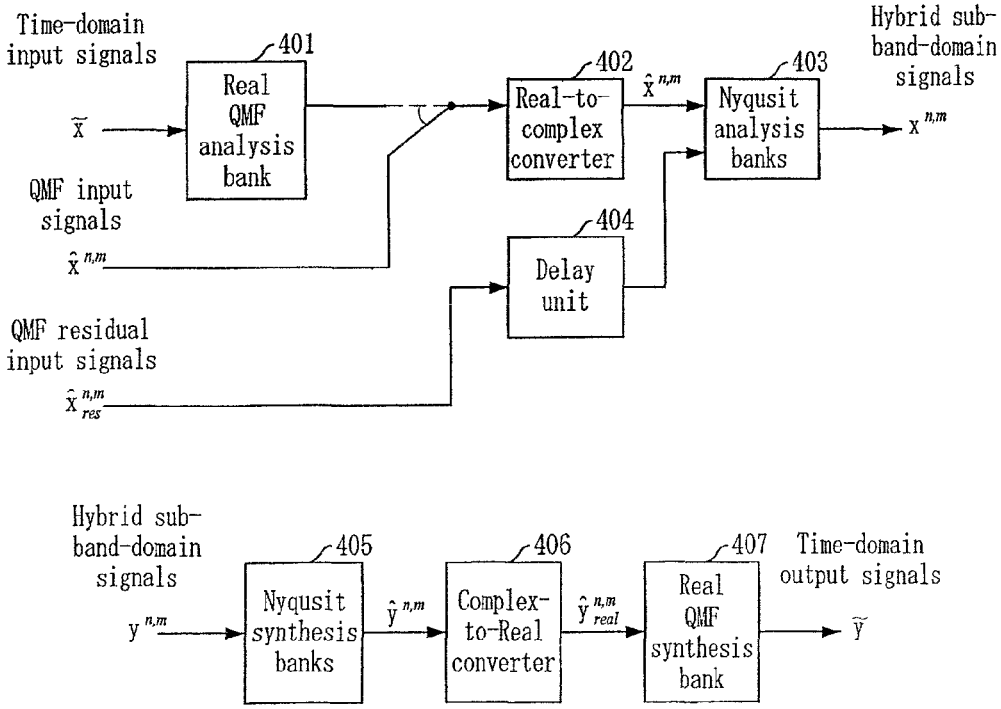
FIG. 4 (PRIOR ART)
FIG. 4 is a block view showing a hybrid analysis filter bank and a hybrid synthesis filter bank of the low-power MPEG surround decoder.

FIG. 4 is a block view showing a hybrid analysis filter bank and a hybrid synthesis filter bank of the low-power MPEG surround decoder.

As shown in the drawing, when downmix signals of the time domain are inputted to the low-power MPEG surround decoder, time delay occurs in a real QMF analysis filter bank 401, a real QMF synthesis filter bank 407, a Nyquist analysis filter bank 403, a Nyquist synthesis filter bank 405, a real-to-complex converter 402, and a complex-to-real converter 406. However, when downmix signals of a real QMF domain outputted from the low-complexity HE-AAC decoder are used, delay occurs only in the real-to-complex converter 402 and the complex-to-real converter 406. The delay caused in the real QMF analysis filter bank 401 and the real QMF synthesis filter bank 407 is already taken into consideration because an SBR tool of the HE-AAC decoder uses an identical QMF filter. Also, since look-ahead information needed for the Nyquist analysis filter bank 403 and the Nyquist synthesis filter bank 405 is available in the SBR tool, additional delay is not needed. In addition, a delay unit 404 for QMF residual signals accounts for the delay introduced by the real-to-complex converter 402 to thereby synchronize signals inputted into the Nyquist analysis filter bank 403.

The present invention provides a method for synchronizing downmix signals of the real QMF domain, downmix signals of the complex QMF domain and downmix signal of the time-domain with output signals of the low-power MPEG surround decoder (i.e., spatial parameters). The process is described with reference to FIG. 5.

Figure 5:
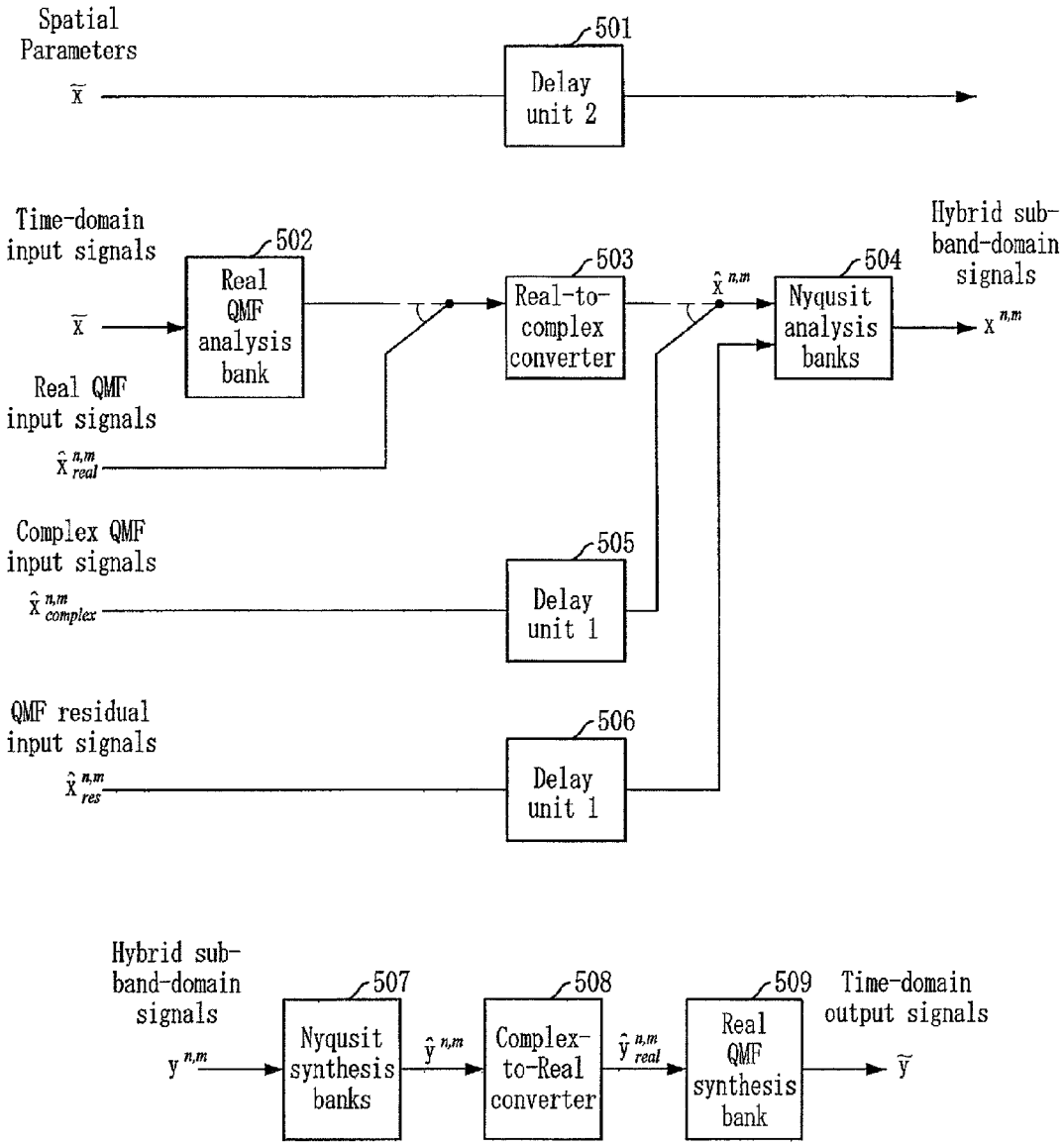
FIG. 5 is a block view describing a hybrid analysis filter bank and a hybrid synthesis filter bank of a low-power MPEG surround decoder including a delay unit according to the present invention.

FIG. 5 is a block view describing a hybrid analysis filter bank and a hybrid synthesis filter bank of a low-power MPEG surround decoder including a delay unit according to the present invention.

When complex QMF signals extracted right ahead of the QMF synthesis filter bank of a general HE-AAC decoder are inputted to a hybrid filter of the low-power MPEG surround decoder, the complex QMF signals does not have to pass through the real-to-complex converter 503. Thus, the downmix signals of the complex QMF domain are directly inputted to the Nyquist analysis filter bank 504. Herein, a delay unit 505 is additionally needed to account for the delay introduced as downmix signals of the time domain or the real QMF domain pass through the real-to-complex converter 503. Just as the downmix signals of the real QMF domain are used, the delays caused by a real QMF analysis filter bank 502, a real QMF synthesis filter bank 509, Nyquist analysis filter banks 504, and Nyquist synthesis filter banks 507 is taken into consideration in the HE-AAC decoder. Thus, there is no additional delay caused by them.

When the time-domain downmix signals decoded at the HE-AAC decoder are provided to the low-power MPEG surround decoder, a delay unit 501 is added to apply delay corresponding to the sum of samples corresponding to the delay caused in the HE-AAC QMF synthesis filter bank, samples corresponding to the delay caused in the real QMF analysis filter bank 502, samples corresponding to the delay caused in the Nyquist analysis filter banks 504, and samples corresponding to the delay caused in the real-to-complex converter 503, to the spatial parameters extracted from MPEG surround side information signals to thereby synchronizing the HE-AAC decoder and the low-power MPEG surround decoder for downmix signals.

Figure 6:
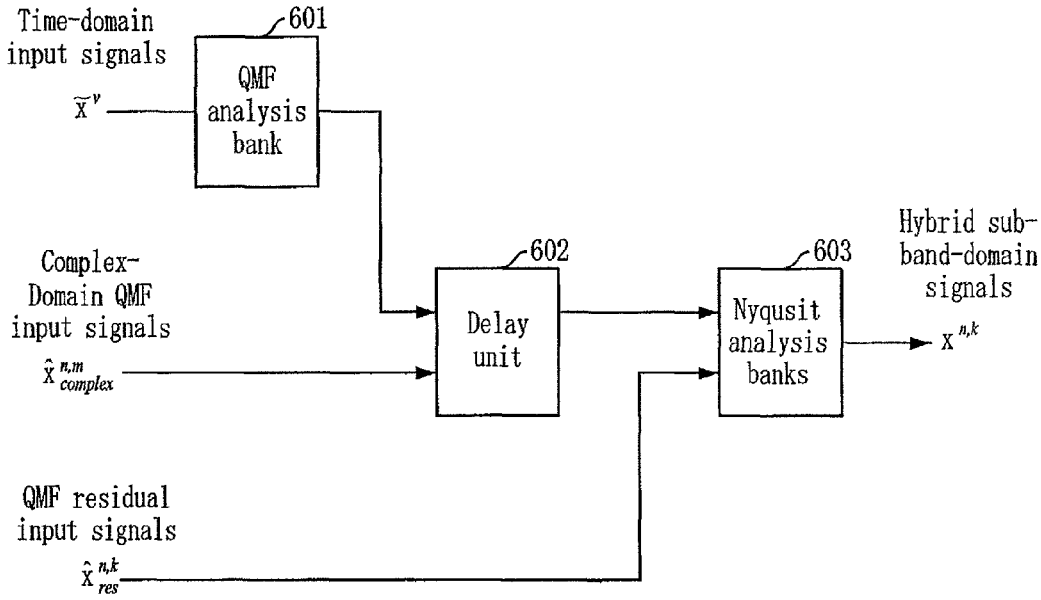
FIG. 6 is a block view illustrating a hybrid analysis filter bank and a hybrid synthesis filter bank of a high-quality MPEG surround decoder including a delay unit according to the present invention.

FIG. 6 is a block view illustrating a hybrid analysis filter bank and a hybrid synthesis filter bank of a high-quality MPEG surround decoder including a delay unit according to the present invention. Referring to the drawing, downmix signals of the time domain are inputted to a delay unit 602 through a QMF analysis filter bank 601, and downmix signals of the complex QMF domain are directly inputted to the delay unit 602. The output of the delay unit 602 is inputted to Nyquist analysis filter bank 603 along with QMF residual input signals, and the Nyquist analysis filter bank 603 outputs hybrid sub-band signals.

As the delay unit 505 is added when an HE-AAC decoder is linked with a low-power MPEG surround decoder, a delay unit 602 is added for the complex QMF signals. The delay unit 602 is added for the complex QMF signals to synchronize a high-quality MPEG surround decoder by accounting for the delay caused in the real-to-complex converter 503 of the low-power MPEG surround decoder.

MODE FOR INVENTION

While the present invention has been described with respect to the specific embodiments, it will be apparent to those skilled in the art that various changes and modifications may be made without departing from the spirit and scope of the invention as defined in the following claims.

INDUSTRIAL APPLICABILITY

The present invention may be applied to synchronize downmix signals with spatial parameters, when high-quality multi-channel audio signals are restored while maintaining compatibility with conventional mono/stereo audio receivers.

The invention claimed is:

1. A high-quality MPEG surround decoder for generating multi-channel audio signals by using side information bitstream and downmix signals of at least one among a real QMF domain, a complex QMF domain, and a time domain, comprising:

a delay unit added to a downmix signal path before a Nyquist analysis filter bank to compensate for a delay introduced in real-to-complex conversion of a low-power MPEG surround decoder.

2. An MPEG surround decoder for generating multi-channel audio signals by using side information bitstream and downmix signals of at least one among a real QMF domain, a complex QMF domain, and a time domain, comprising:

a QMF analyzing unit for performing real QMF analysis onto downmix signals of the time domain;

a real-to-complex converting unit for converting downmix signals of the real QMF domain into downmix signals of the complex QMF domain; and a delay unit for applying delay introduced in the real-to-complex conversion to downmix signals of the complex QMF domain.

3. The MPEG surround decoder of claim 2, further comprising:

a delay unit for applying a delay introduced in the MPEG surround decoder for the downmix signals of the time domain to spatial parameters extracted from the side information bitstream.

4. The MPEG surround decoder of claim 2, further comprising:

a delay unit for applying a delay introduced in the real-to-complex converting unit to QMF residual signals.

5. A method for restoring multi-channel audio signals, comprising the step of:

outputting downmix signals of at least one among a real QMF domain, a complex QMF domain, and time domain by decoding downmix signal bitstream; and generating multi-channel audio signals based on side information bitstream and the downmix signals, wherein the step of generating multi-channel audio signals includes the steps of:

performing real QMF analysis onto downmix signals of the time domain;

converting downmix signals of the real QMF domain into downmix signals of the complex QMF domain; and applying delay introduced in the real-to-complex conversion to downmix signals of the complex QMF domain.

6. The method of claim 5, further comprising the step of:

applying a delay introduced in the step of generating multi-channel audio signals for downmix signals of the time domain to spatial parameters extracted from the side information bitstream.

7. The method of claim 5, further comprising the step of:

applying a delay introduced in the step of converting downmix signals of the real QMF domain into downmix signals of the complex QMF domain to QMF residual signals.

* * * * *